US011013373B1

(12) United States Patent
Lumpkin et al.

(10) Patent No.: US 11,013,373 B1
(45) Date of Patent: May 25, 2021

(54) SHOWER SPRAY CHAIR APPARATUS

(71) Applicants: Nathaniel Lumpkin, Riverside, CA (US); Karen Lumpkin, Riverside, CA (US)

(72) Inventors: Nathaniel Lumpkin, Riverside, CA (US); Karen Lumpkin, Riverside, CA (US)

( * ) Notice: Subject to any disclaimer, the term of this patent is extended or adjusted under 35 U.S.C. 154(b) by 0 days.

(21) Appl. No.: 16/722,079

(22) Filed: Dec. 20, 2019

(51) Int. Cl.
*A47K 3/12* (2006.01)
*A47K 3/28* (2006.01)

(52) U.S. Cl.
CPC ..... *A47K 3/122* (2013.01); *A47K 3/282* (2013.01)

(58) Field of Classification Search
CPC ..... A47K 3/12; A47K 3/122; A47K 3/282; A61G 7/0005; A61G 7/1003
See application file for complete search history.

(56) References Cited

U.S. PATENT DOCUMENTS

| | | | | |
|---|---|---|---|---|
| 3,040,335 | A | 6/1962 | Gellman | |
| 3,169,253 | A | 2/1965 | Segar | |
| 4,565,409 | A * | 1/1986 | Hollonbeck | A47C 16/00 297/411.1 |
| D297,991 | S | 10/1988 | Boyle | |
| 5,063,621 | A | 11/1991 | Sellars | |
| 6,842,919 | B2 | 1/2005 | Wilson | |
| 7,252,329 | B1 | 8/2007 | O'Meally | |
| D666,435 | S | 9/2012 | Meyers | |
| 8,281,428 | B1 | 10/2012 | Shrewsbury | |
| 9,763,545 | B2 * | 9/2017 | Liu | A47K 3/282 |
| 10,813,506 | B1 * | 10/2020 | Mitrano | A47K 3/282 |
| 2020/0229653 | A1 * | 7/2020 | Williams | A47K 3/125 |

* cited by examiner

*Primary Examiner* — Erin Deery

(57) ABSTRACT

A shower spray chair apparatus for assisted washing for elderly or disabled people includes a chair back and a chair bottom coupled to a chair frame. An inlet tube is coupled to an inlet aperture of the chair back to feed water into a back cavity of the chair back and at least one connector tube joins the back cavity to a bottom cavity of the chair bottom. The chair back and the chair bottom each a plurality of spray holes to deliver water from the back cavity and the bottom cavity, respectively, and a plurality of through holes to prevent water from pooling. A plurality of legs is coupled to the chair bottom.

14 Claims, 5 Drawing Sheets

SHOWER SPRAY CHAIR APPARATUS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to shower chairs and more particularly pertains to a new shower chair for assisted washing for elderly or disabled people.

BRIEF SUMMARY OF THE INVENTION

An embodiment of the disclosure meets the needs presented above by generally comprising a chair frame that has a frame that has a frame back side and a frame bottom side. A chair back is coupled to the frame back side of the chair frame. The chair back has an inner side separated from an outer side forming a back cavity. The inner side has a plurality of back through holes extending through the outer side. Each of the plurality of back through holes has a back side wall enclosing the back cavity. The inner side has a plurality of back spray holes extending through to the back cavity. A top edge of the chair back has at least one back inlet aperture extending through to the back cavity. A bottom edge of the chair back has at least one back outlet aperture extending through to the back cavity. An inlet tube has at least one chair end coupled to the back inlet apertures and a connector end configured to connect to a water supply. A chair bottom is coupled to the chair frame. The chair bottom is coupled to the frame bottom side and has an upper side separated from a lower side forming a bottom cavity. The upper side has a plurality of bottom through holes extending through the lower side. Each of the plurality of bottom through holes has a bottom side wall enclosing the bottom cavity. The upper side has a plurality of bottom spray holes extending through to the bottom cavity. A back edge of the chair bottom has at least one bottom inlet aperture extending through to the bottom cavity. At least one connector tube extends from the back outlet apertures to the bottom inlet apertures. The bottom cavity, the connector tubes, the back cavity, and the inlet tube are all in fluid communication to deliver water from the connector end through the back spray holes and the bottom spray holes. A plurality of legs is coupled to the chair bottom.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
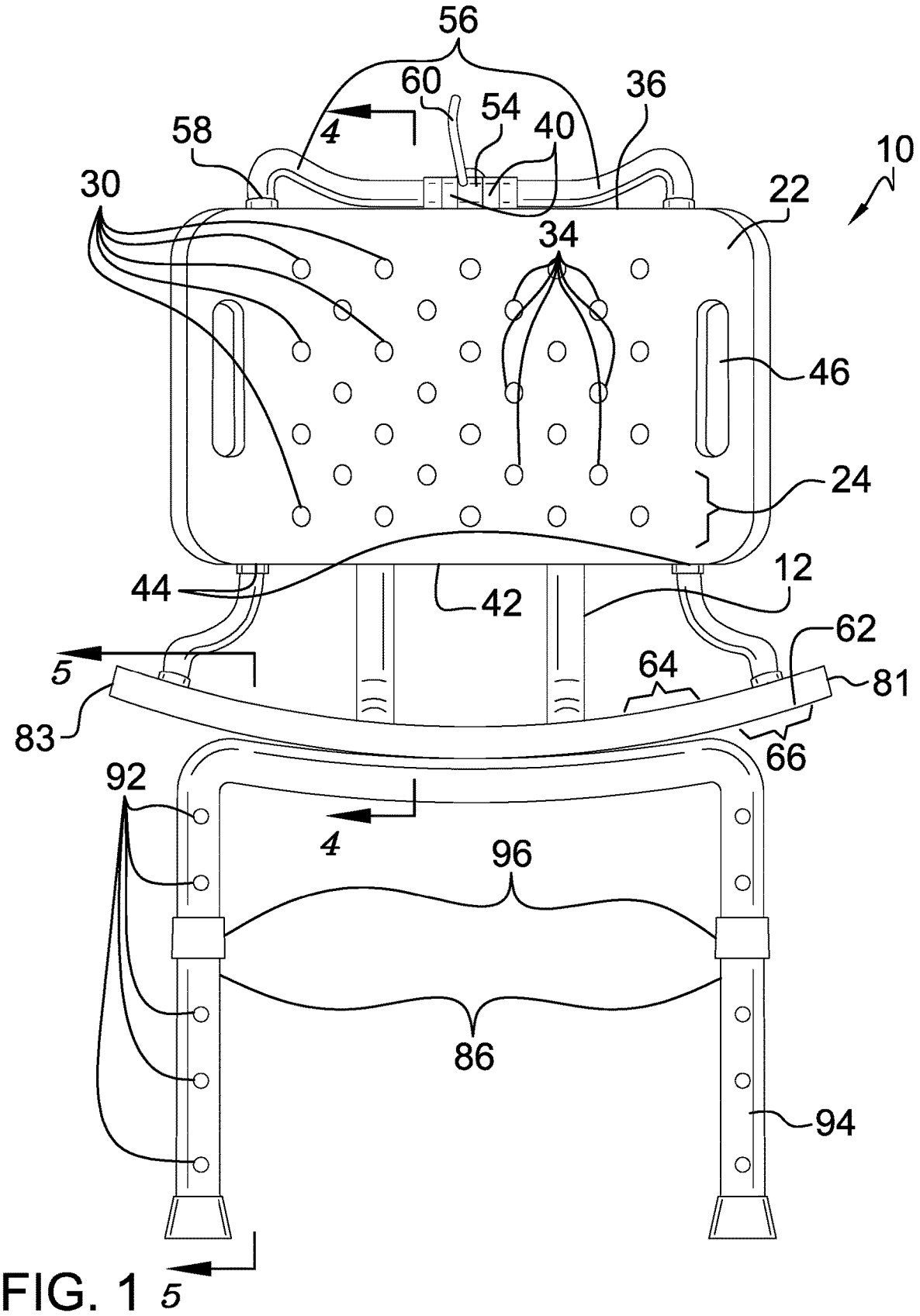
FIG. 1 is a front elevation view of a shower spray chair apparatus according to an embodiment of the disclosure.
Figure 2:
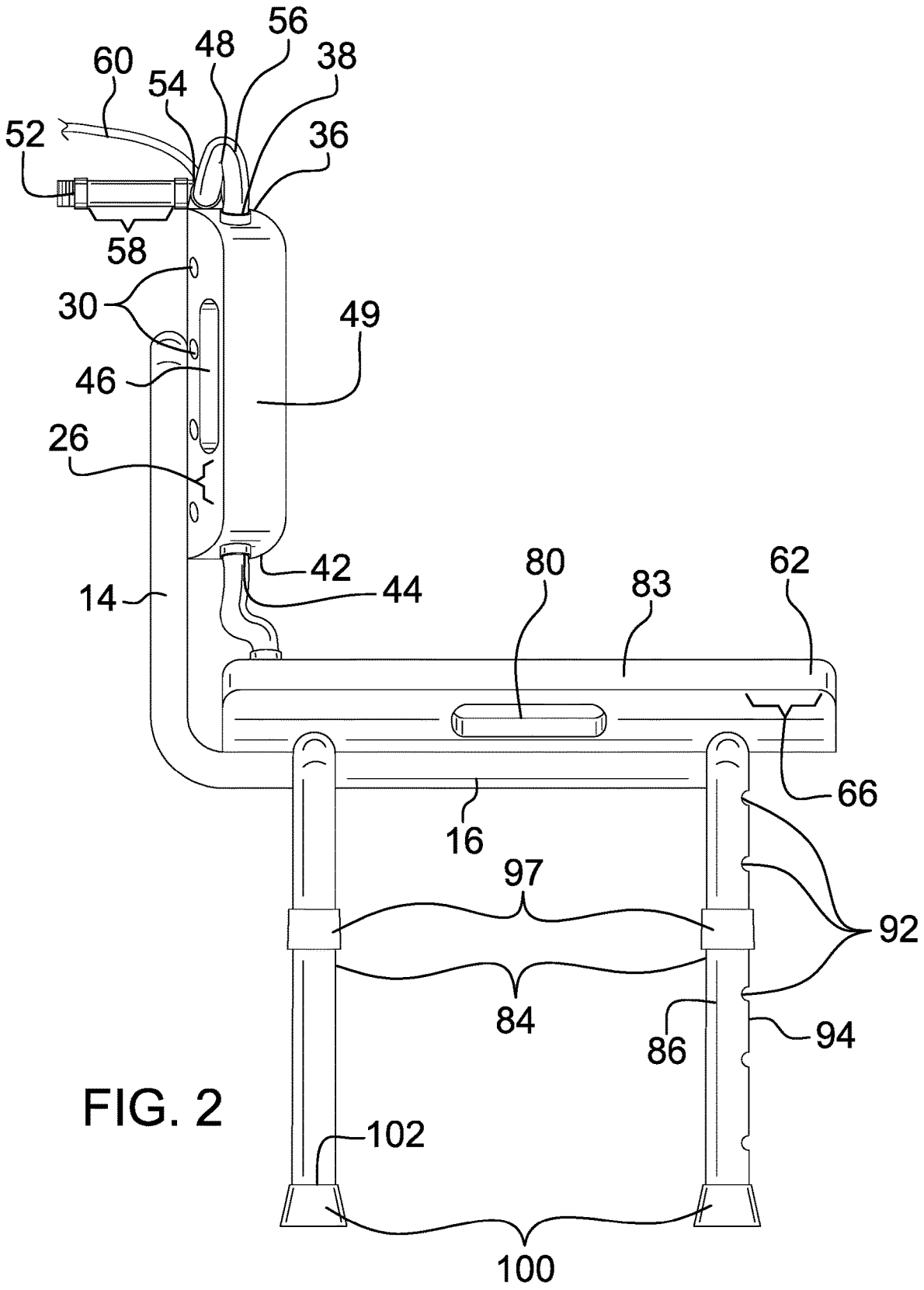
FIG. 2 is a side elevation view of an embodiment of the disclosure.
Figure 3:
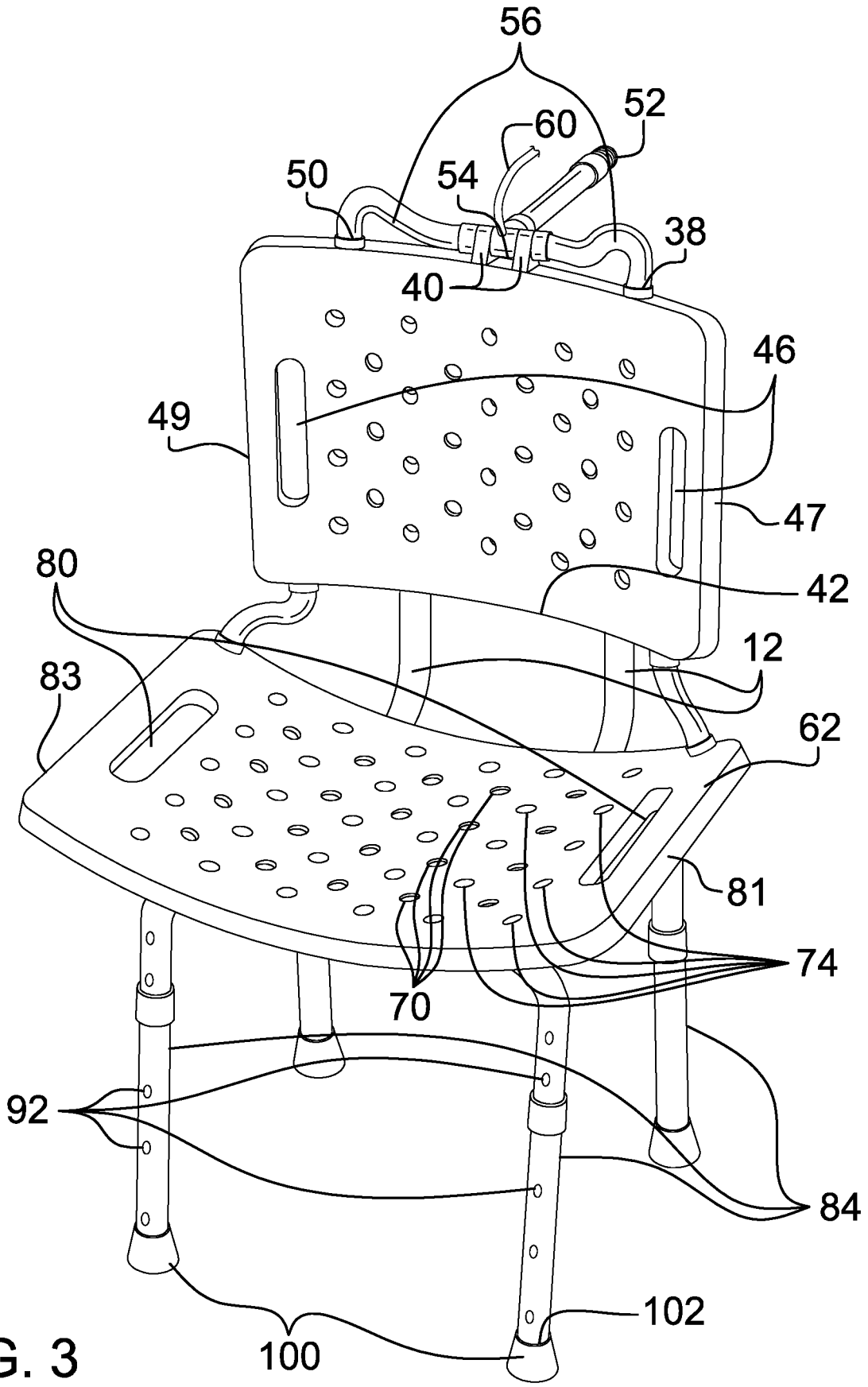
FIG. 3 is a front elevation view of an embodiment of the disclosure.
Figure 4:
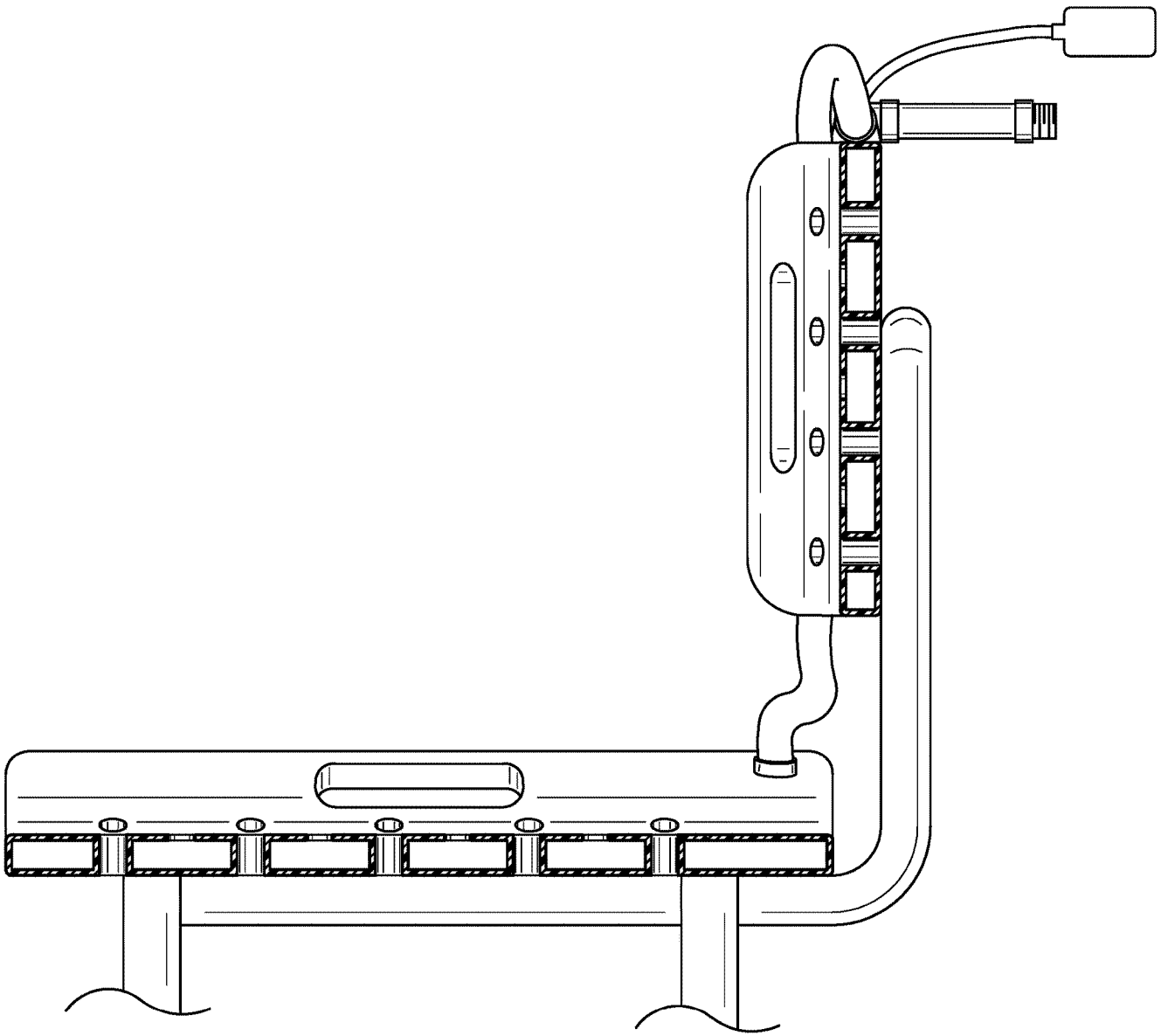
FIG. 4 is a cross section view (along the lines 4-4) view of an embodiment of the disclosure.
Figure 5:
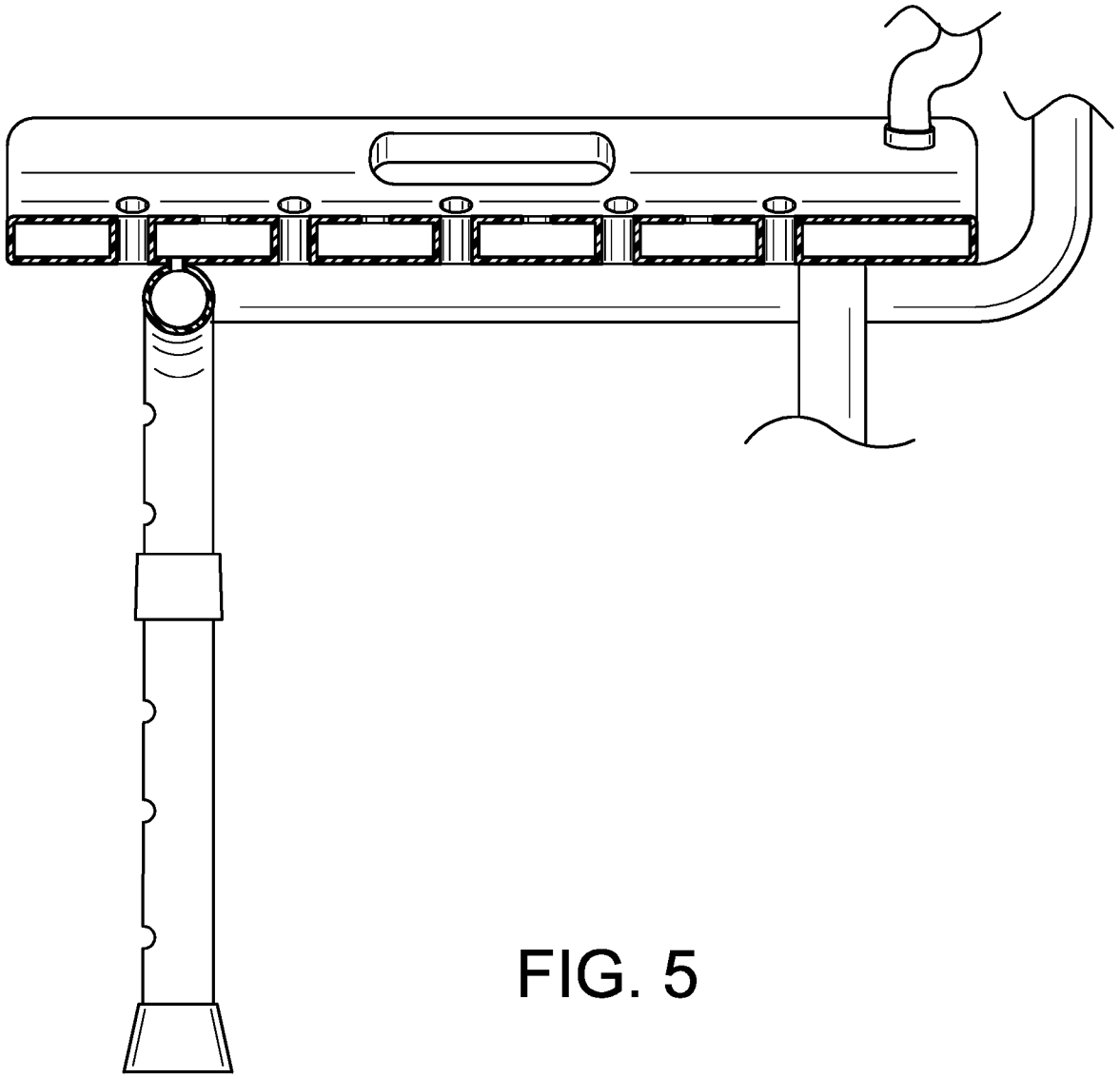
FIG. 5 is a cross section view (along the lines 5-5) view of an embodiment of the disclosure.

With reference now to the drawings, and in particular to FIGS. 1 through 5 thereof, a new shower chair embodying the principles and concepts of an embodiment of the disclosure and generally designated by the reference numeral 10 will be described.

As best illustrated in FIGS. 1 through 5, the shower spray chair apparatus 10 generally comprises a chair frame 12 having a frame back side 14 and a frame bottom side 16. The chair frame 12 comprises a frame tube 18 bent into a pair of parallel L-shaped portions 20. A chair back 22 is coupled to the frame back side 14 of the chair frame. The chair back 22 has an inner side 24 separated from an outer side 26 forming a back cavity 28. The inner side 24 has a plurality of back through holes 30 extending through the outer side 26. Each of the plurality of back through holes 30 has a back side wall 32 enclosing the back cavity 28. The inner side 24 has a plurality of back spray holes 34 extending through to the back cavity 28. The back through holes 30 and the back spray holes 34 may be arranged in alternating horizontal rows. A top edge 36 of the chair back 22 has at least one back inlet aperture 38 extending through to the back cavity 28. The chair back 22 has a pair of inlet mounts 40 coupled to the top edge 36. A bottom edge 42 of the chair back 22 has at least one back outlet aperture 44 extending through to the back cavity 28. The chair back 22 is concave and has a pair of back handle apertures 46 extending therethrough adjacent a back left edge 47 and a back right edge 49.

An inlet tube 48 has at least one chair end 50 coupled to the back inlet apertures 38 of the chair back and a connector end 52 that is configured to connect to a water supply. The inlet tube 48 has a T-shaped splitter 54 pivotably coupled to the pair of inlet mounts 40. A pair of chair feed tubes 56 extend from the splitter 54 to the chair ends 50 and a connector portion 58 extends from the splitter 54 to the connector end 52. A soap feed tube 60 may be coupled to the splitter 54 of the inlet tube 48. The soap feed tube 60 is configured to be connected to a liquid soap supply to soap the water entering the apparatus 10. A chair bottom 62 is coupled to the frame bottom side 16 of the chair frame 12. The chair bottom 62 has an upper side 64 separated from a lower side 66 that forms a bottom cavity 68. The upper side 64 has a plurality of bottom through holes 70 extending through the lower side 66. Each of the plurality of bottom through holes 70 has a bottom side wall 72 enclosing the bottom cavity 68. The upper side 64 has a plurality of bottom spray holes 74 extending through to the bottom cavity 68. The bottom through holes 70 and the bottom spray holes 74 may be arranged in alternating horizontal rows. A back edge 76 of the chair bottom 62 has at least one bottom inlet aperture 78 extending through to the bottom cavity 68. The chair bottom 62 is concave and has a pair of bottom handle apertures 80 extending therethrough adjacent a bottom left edge 81 and a bottom right edge 83.

At least one connector tube extends 82 from the back outlet apertures 44 to the bottom inlet apertures 78. The connector tubes 82 may be bent to allow for the back outlet apertures 44 and bottom inlet apertures 78 to not be aligned. The bottom cavity 68, the connector tubes 82, the back cavity 28, and the inlet tube 48 are all in fluid communication to deliver water from the connector end 52 through the back spray 34 holes and the bottom spray holes 74. A plurality of legs 84 is coupled to the chair bottom 62. A pair of hollow front legs 86 of the plurality of legs 84 has a leg inlet aperture 88 that is in fluid communication with a leg feed aperture 90 extending through the lower side 66 of the chair bottom 62 to the bottom cavity 68. Each of the front legs 86 has a plurality of leg spray holes 92 extending through a front edge 94 and are in fluid communication with the bottom cavity 68. Each of the plurality of legs 84 may be telescopable and has a leg adjustment mechanism 96. The leg adjustment mechanism 96 is a twist clamp 97 or other type of releasable mechanism such as, but not limited to, spring-loaded buttons and corresponding button apertures, lever clamps, and the like. Each of a plurality of feet 98 has an anti-slip foot 100 coupled to a distal end 102 thereof. The anti-slip foot 100 may be a truncated conical shape.

In use, each of the plurality of legs 84 is adjusted to an appropriate height and the connector end 52 of the inlet tube 48 is engaged with a water supply. The user sits on the apparatus 10 to be cleaned with water coming through the plurality of back spray holes 34, the plurality of bottom spray holes 74, and the plurality of leg spray holes 92 to more conveniently and safely wash difficult to reach places. The soap feed tube 60 is connected to a soap dispenser as desired to release soapy water.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A shower spray chair apparatus comprising:

a chair frame, the chair frame having a frame back side and a frame bottom side;

a chair back coupled to the chair frame, the chair back being coupled to the frame back side, the chair back having an inner side separated from an outer side forming a back cavity, the inner side having a plurality of back through holes extending through the outer side, each of the plurality of back through holes having a side wall enclosing the back cavity, the inner side having a plurality of back spray holes extending through to the back cavity, a top edge of the chair back having at least one back inlet aperture extending through to the back cavity, a bottom edge of the chair back having at least one back outlet aperture extending through to the back cavity;

an inlet tube coupled to the chair back, the inlet tube having at least one chair end coupled to the at least one back inlet aperture and a connector end configured to connect to a water supply;

a chair bottom coupled to the chair frame, the chair bottom being coupled to the frame bottom side, the chair bottom having an upper side separated from an lower side forming a bottom cavity, the upper side having a plurality of bottom through holes extending through the lower side, each of the plurality of bottom through holes having a side wall enclosing the bottom cavity, the upper side having a plurality of bottom spray holes extending through to the bottom cavity, a back edge of the chair bottom having at least one bottom inlet aperture extending through to the bottom cavity;

at least one connector tube, the at least one connector tube extending from the at least one back outlet aperture to the at least one bottom inlet aperture, the bottom cavity, the at least one connector tube, the back cavity, and the inlet tube all being in fluid communication to deliver water from the connector end through the back spray holes and the bottom spray holes; and a plurality of legs coupled to the chair bottom.

2. The shower spray chair apparatus of claim 1 further comprising a pair of hollow front legs of the plurality of legs each having a leg inlet aperture in fluid communication with a leg feed aperture extending through the lower side of the chair bottom to the bottom cavity, each of the front legs having a plurality of leg spray holes extending through a front edge and in fluid communication with the bottom cavity.

3. The shower spray chair apparatus of claim 1 further comprising each of the plurality of legs being telescopable and having a leg adjustment mechanism.

4. The shower spray chair apparatus of claim 3 further comprising the leg adjustment mechanism being a twist clamp.

5. The shower spray chair apparatus of claim 1 further comprising each of the chair back and the chair bottom being concave.

6. The shower spray chair apparatus of claim 1 further comprising each of the chair back and the chair bottom having a pair of back handle apertures and a pair of bottom handle apertures extending therethrough, respectively.

7. The shower spray chair apparatus of claim 1 further comprising each of the plurality of legs having an anti-slip foot coupled to a distal end thereof.

8. The shower spray chair apparatus of claim 7 further comprising the anti-slip foot being a truncated conical shape.

9. The shower spray chair apparatus of claim 1 further comprising the plurality of back through holes and the plurality of back spray holes being arranged in alternating horizontal rows and the plurality of bottom through holes and the plurality of bottom spray holes being arranged in alternating horizontal rows.

10. The shower spray chair apparatus of claim 1 further comprising a soap feed tube coupled to the inlet tube between the at least one chair end and the connector end, the soap feed tube being configured to be connected to a liquid soap supply to soap the water entering the apparatus.

11. The shower spray chair apparatus of claim 1 further comprising:

the at least one back inlet aperture being a plurality of back inlet apertures; and the chair back having a pair of inlet mounts coupled to the top edge, the inlet tube having a T-shaped splitter pivotably coupled to the pair of inlet mounts, wherein the at least one chair end is two chair ends extending from the splitter to the plurality of back inlet apertures, a connector portion extending from the splitter to the connector end.

12. The shower spray chair apparatus of claim 11 further comprising a soap feed tube coupled to the splitter of the inlet tube, the soap feed tube being configured to be connected to a liquid soap supply to soap the water entering the apparatus.

13. The shower spray chair apparatus of claim 1 further comprising the chair frame comprising a frame tube bent into a pair of parallel L-shaped portions.

14. A shower spray chair apparatus comprising:

a chair frame, the chair frame having a frame back side and a frame bottom side, the chair frame comprising a frame tube bent into a pair of parallel L-shaped portions;

a chair back coupled to the chair frame, the chair back being coupled to the frame back side, the chair back having an inner side separated from an outer side forming a back cavity, the inner side having a plurality of back through holes extending through the outer side, each of the plurality of back through holes having a side wall enclosing the back cavity, the inner side having a plurality of back spray holes extending through to the back cavity, the plurality of back through holes and the plurality of back spray holes being arranged in alternating horizontal rows, a top edge of the chair back having a plurality of back inlet apertures extending through to the back cavity, the chair back having a pair of inlet mounts coupled to the top edge, a bottom edge of the chair back having at least one back outlet aperture extending through to the back cavity, the chair back being concave, the chair back having a pair of back handle apertures extending therethrough;

an inlet tube coupled to the chair back, the inlet tube coupled to the plurality of back inlet apertures and a connector end configured to connect to a water supply, the inlet tube having a T-shaped splitter pivotably coupled to the pair of inlet mounts, two chair ends extending from the splitter to the plurality of back inlet apertures, a connector portion extending from the splitter to the connector end;

a soap feed tube coupled to the splitter of the inlet tube, the soap feed tube being configured to be connected to a liquid soap supply to soap the water entering the apparatus;

a chair bottom coupled to the chair frame, the chair bottom being coupled to the frame bottom side, the chair bottom having an upper side separated from an lower side forming a bottom cavity, the upper side having a plurality of bottom through holes extending through the lower side, each of the plurality of bottom through holes having a side wall enclosing the bottom cavity, the upper side having a plurality of bottom spray holes extending through to the bottom cavity, the plurality of bottom through holes and the plurality of bottom spray holes being arranged in alternating horizontal rows, a back edge of the chair bottom having at least one bottom inlet aperture extending through to the bottom cavity, the chair bottom being concave, the chair bottom having a pair of bottom handle apertures extending therethrough;

at least one connector tube, the at least one connector tube extending from the at least one back outlet aperture to the at least one bottom inlet aperture;

the bottom cavity, the at least one connector tube, the back cavity, and the inlet tube all being in fluid communication to deliver water from the connector end through the back spray holes and the bottom spray holes; and a plurality of legs coupled to the chair bottom, a pair of hollow front legs of the plurality of legs each having a leg inlet aperture in fluid communication with a leg feed aperture extending through the lower side of the chair bottom to the bottom cavity, each of the front legs having a plurality of leg spray holes extending through a front edge and in fluid communication with the bottom cavity, each of the plurality of legs being telescopable and having a leg adjustment mechanism, the leg adjustment mechanism being a twist clamp, each of the plurality of legs having an anti-slip foot coupled to a distal end thereof, the anti-slip foot being a truncated conical shape.

* * * * *